US006850467B2

(12) United States Patent
Watanabe et al.

(10) Patent No.: US 6,850,467 B2
(45) Date of Patent: Feb. 1, 2005

(54) JUMPER STRUCTURE AND TIMEPIECE HAVING THE SAME

(75) Inventors: Mamoru Watanabe, Chiba (JP); Morinobu Endo, Suzaka (JP)

(73) Assignee: Seiko Instruments Inc., Chiba (JP)

( * ) Notice: Subject to any disclaimer, the term of this patent is extended or adjusted under 35 U.S.C. 154(b) by 361 days.

(21) Appl. No.: 10/134,170

(22) Filed: Apr. 26, 2002

(65) Prior Publication Data

US 2002/0167864 A1 Nov. 14, 2002

(30) Foreign Application Priority Data

May 11, 2001 (JP) ..... 2001-142142

(51) Int. Cl.[7] ..... G04B 19/24; G04B 19/20
(52) U.S. Cl. ..... 368/28; 368/38
(58) Field of Search ..... 368/28, 33–38

(56) References Cited

U.S. PATENT DOCUMENTS 3,888,076 A * 6/1975 Zaugg et al. ..... 368/38
4,048,795 A * 9/1977 Risi ..... 368/38
4,171,610 A * 10/1979 Gilomen ..... 368/38
5,521,889 A * 5/1996 Scarinzi et al. ..... 368/294

* cited by examiner

*Primary Examiner*—Vit W. Miska
(74) *Attorney, Agent, or Firm*—Adams & Wilks

(57) ABSTRACT

To provide a jumper structure which is light-weighted and capable of reducing fabrication cost and a timepiece using the same. A jumper structure of a timepiece is constituted by integrally molding a jumping and restricting portion made of carbon nanofiber and a spring portion made of carbon nanofiber. A jumping and restricting portion of the jumper structure is thicker than the spring portion and the jumping and restricting portion includes a projected portion in a flat plate shape and in an eaves-like shape.

20 Claims, 5 Drawing Sheets

JUMPER STRUCTURE AND TIMEPIECE HAVING THE SAME

BACKGROUND OF THE INVENTION

1. Field of the Invention

The present invention relates generally to a jumper structure and, in great detail, to a jumper structure suitable for being used in a precision apparatus a thickness of which is restricted, such as a watch.

2. Description of the Prior Art

It is well known in a watch or the like to use a jumper structure for rotating a date indicator for indicating a date having a date feeding finger engaged with teeth of the date indicator and having a jumping and restricting portion loaded by a spring and engaged with the teeth of the date indicator to stop rotation of the date indicator at every pitch of the teeth.

According to such a jumper structure, the jumping and restricting portion is thickly formed in order to make engagement between the jumping and restricting portion and the teeth of the date indicator difficult to disengage even when an impact occurs by dropping the watch. When the thick jumping and restricting portion is used, the jumping and restricting portion is formed by resin (plastic) in order to minimize mass (weight). Meanwhile, since the spring portion is always applied with a load an therefore, it is difficult to use a resin which is difficult to avoid a creep phenomenon owing to plastically flowing performance and a metal material is used as a material of the spring portion. As a result, typically, the jumper structure is provided as a composite structure constituted by mutually fixing and coupling the jumping and restricting portion made of a resin and the spring portion made of a metal.

However, according to such a composite structure, not only is part cost or fabrication cost likely to increase but also there is a concern that a dispersion is likely be to caused in a property of the composite structure.

Further, although there is known a constitution in which a jumping and restricting portion and a spring portion are integrally formed by a metal material having spring performance, when the jumping and restricting portion is thinned to minimize weight, there is a concern that engagement between the jumping and restricting portion and a teeth portion of a date indicator is liable to disengage.

Meanwhile, recently, there has been proposed to make a coil spring by molding a carbon nanofiber by a resin.

SUMMARY OF THE INVENTION

The invention has been carried out in view of the above-described various points and it is an object thereof to provide a jumper structure which is light-weighted and capable of reducing fabrication cost and a timepiece using the same.

In order to achieve the above-described object, according to the invention, there is provided a jumper structure integrally molded with a jumping and restricting portion made of a carbon nanofiber and a spring portion made of a carbon nanofiber.

According to the jumper structure of the invention, since the spring portion is made of carbon nanofiber, even when load or stress is always applied to the spring portion, there is rarely a concern of reducing spring performance by a creep phenomenon or plastic flow. Further, according to the jumper structure of the invention, since the jumping and restricting portion is made of carbon nanofiber, the specific weight of the jumping and restricting portion is smaller than that of a rigid metal material or the like and therefore, there is not a concern of excessively increasing the weight of the jumping and restricting portion and the thickness of the jumping and restricting portion can be increased. Therefore, there can be minimized a concern of disengaging engagement between the jumping and restricting portion of the jumper structure and a teeth portion engaged with and restrained by the jumping and restricting portion. Further, according to the jumper structure of the invention, since the jumping and restricting portion and the spring portion are integrally molded, integration cost of the jumper structure can be minimized. Further, according to the jumper structure of the invention, since both of the jumping and restricting portion and the spring portion which are integrally molded, are made of carbon nanofiber and can be formed typically by a material having substantially the same or similar composition, integral performance thereof can highly be maintained.

Further, according to the jumper structure of the invention, since the jumping and restricting portion is made of carbon nanofiber, the frictional coefficient of the jumping and restricting portion is small and therefore, the force necessary for releasing the stopping force of the jumping and restricting portion, is obtained by a minimum force larger than the resistance or load prescribed by shapes of the jumping a d restricting portion and the teeth portion, and the strength of a spring of the spring portion and energy consumption necessary for causing a jumping operation of a jumping and restricting operation can be minimized. Further, when the frictional coefficient of the jumping and restricting portion is large, a dispersion in frictional force caused by a dispersion in the frictional coefficient also become large, there is a concern of enlarging a dispersion in force necessary for releasing stopping by the jumping and restricting portion and it is necessary to design a rotational drive system of a date indicator or the like in consideration of a maximum value of the dispersion, however, according to the jumper structure of the invention, such an excessive design can be restrained to a minimum.

In the specification, with regard to the jumping and restricting portion and the spring portion, the phrase "made of carbon nanofiber" includes carbon nanofiber as a major component such that the property of carbon nanofiber that the specific weight is small can be made full use of so that stable spring performance with no creep can be brought about, and a rate of carbon nanofiber falls in a range of about 1% through about 60% in weight. Further, a coupling material or a binder for mutually coupling carbon nanofibers in order to integrally mold the jumper structure, may be constituted by a resin or the like, may include a resin or the like, may be comprised of a constitution produced by baking and actually carbonizing a resin or the like so far as the coupling material or the binder falls in a range capable of substantially avoiding the creep phenomenon or flow of composition in the binder material of the spring portion.

The integrally molded jumper structure made of carbon nanofiber may be formed by mixing power of carbon nanofiber to, for example, thermoplastic plastic, molding by injection molding or powder molding and baking the mixture to thereby substantially sinter the mixture while carbonizing the plastic material, or may be formed by mixing the powder with a material of thermosetting plastic, molding by compression molding or transfer molding or the like and baking the mixture to thereby substantially sinter the mixture while carbonizing the plastic material.

Although carbon nanofiber used in molding is typically constituted by so-to-speak single layer carbon nanotube, the carbon nanofiber may be constituted by a plural layers (multiple layers) or may be mixed with single layer ones and plural layer ones. In the case of multiple layers, two or three layers thereof may be laminated and more layers, for example, several tens layers thereof may be laminated. Depending on cases, several hundreds layers or more thereof may be laminated. Further, the carbon nanofiber may be constructed by a constitution having a constant diameter or chiral angle or spiral pitch thereof or mixed with constitutions having different diameters and chiral angles. Further, a diameter or the like of the respective carbon nanofiber per se may not be constant. Further, although carbon nanofiber typically comprises only carbon, depending on cases, small particles of carbon of other kind (small particles in the form of graphite, small particles in the form of amorphous carbon, small particles in the form of carbon black or the like) or other kind of atoms, molecules or small particles or the like may adhere to a surface of the nanofiber or mixed with nanofiber particles.

In molding, carbon nanofiber typically comprises powder or a small particles such that the carbon nanofiber is easy to be dispersed uniformly in a comparatively small amount of a resin material for constituting a binder and a diameter thereof falls in a range of about 1 nm (nanometer) through about several tens nm and a length thereof falls in a range of about several nm through several thousands nm. Further, an aspect ratio thereof is equal to or larger than 50.

In molding by using a resin material, it is preferable that a rate of a molding material such as a resin material is comparatively small in order to minimize the change in dimension and shape by carbonizing and sintering after molding the resin. When small particles of carbon nanofiber are small and a molding material including a resin material and a molding assisting agent added as necessary, can be provided with sufficient fluidity, there is used injection molding utilizing a thermoplastic resin or compression molding or transfer molding utilizing thermosetting resin material. In this case, a rate of small particles of carbon nanofiber is preferably equal to or higher than, for example, about 50% in volume, depending on cases, the rate may be smaller, for example, may be about 20 through 30% in volume. Further, when the rate of the carbon nanofiber is increased, powder molding may be carried out in the state of powder along with a small amount of a binder.

Carbonizing and baking (typically sintering) after molding a resin are typically carried out after removing the product from a molding die. However, when desired, after molding, at inside of the molding die, the product may further be carbonized or carbonized and baked. Further, a degree of carbonizing and baking may pertinently be selected in accordance with spring performance to be provided to the spring portion of the jumper structure and low frictional performance desired in the jumping and restricting portion. For example, in carbonizing, the resin may partially remain so far as plastic fluidity particular to resin can be avoided from being caused at a portion for constituting the spring portion and a degree of sintering by baking may be restrained to be low when the resin can operate partially as a binder between carbon nanofibers. Temperature, time period and atmospheric condition of sintering by carbonizing or baking may pertinently be changed in accordance with kind and rate of a resin material.

Further, although according to the above-described, an explanation has been given such that a total of the jumper structure is formed by one kind of a blend material and under the same carbonizing and baking condition, the spring portion and the jumping and restricting portion may be formed by materials having different blending rates or the spring portion and the jumping and restricting portion may be carbonized or baked (sintered or the like) at different temperatures.

In order to prevent engagement between the jumping and restricting portion and the teeth portion to which the jumping and restricting portion is engaged, from being disengaged in the axial line direction of the teeth, as described above, it is preferable that the thickness of the jumping and restricting portion with regard to the axial line direction is comparatively large and typically, the jumping and restricting portion (more in details, a jumping and restricting finger portion of the jumping and restricting portion) is formed more thickly than the spring portion. However, for example, when a thickness of the spring portion with regard to the above-described axis line direction, that is, a length of the spring portion in the width direction is made comparatively large, the jumping and restricting portion and the spring portion may be constituted by the same degree of thickness or the spring portion may be thicker than the jumping and restricting portion. Further, the thickness of the teeth portion in the axial line direction, is comparatively small typically in order to minimize mass of the teeth portion and therefore, the jumping and restricting portion is typically formed to be thicker than the teeth portion.

In order to minimize a concern of disengaging engagement between the jumping and restricting portion and the teeth portion in the axial line direction of the teeth portion by impact of drop or the like, the jumping and restricting portion is provided with a restricting portion for restricting a positional shift of the jumping and restricting portion in the thickness direction of the jumping and restricting portion relative to the teeth portion engaged with the jumping and restricting finger portion of the jumping and restricting portion. However, when the jumping and restricting portion is thick, the restricting portion may be dispensed with. The restricting portion is typically projected in an eaves-like shape to be opposed to an end face in the axial line direction of the teeth portion by being brought into contact with or locked by the end face to thereby enable to restrict the positional shift in the axial line direction. Although the eaves-like projected restricting portion may be constituted by a rod-like shape, the portion typically comprises a projected portion in a flat plate shape and in an eaves-like shape broadly projected to be able to be brought into contact with end faces of the plurality of teeth of the teeth portion. In this case, typically, by the restricting portion comprising the projected portion in the flat plate shape and in the eaves-like shape, a positional shift in the axial line direction between the jumping and restricting finger portion of the jumping and restricting portion and the teeth portion is restricted, thereby, engagement between the both can be prevented from being disengaged. Further, since the jumping and restricting portion is made of carbon nanofiber having the small specific weight and therefore, even when the jumping and restricting portion is provided with such an extra restricting portion, an increase in the mass is restrained to the minimum and excessive load can be avoided from applying to the rotational drive system or the like.

Such a jumper structure is typically used in a precision apparatus or the like a thickness of which is desired to be restrained to a minimum as in a watch or the like. In that case, such a jumper structure is engaged with a wheel for indicating date as in a date indicator or a day indicator of a timepiece and a wheel having teeth at a peripheral face thereof, that is, a teeth portion of a toothed wheel to restrain rotation of the toothed wheel. However, it is apparent that the jumper structure can be integrated to other arbitrary machine or apparatus.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Next, an explanation will be given of a preferable mode for carrying out the invention in reference to a preferable embodiment shown by the attached drawings.

Figure 2:
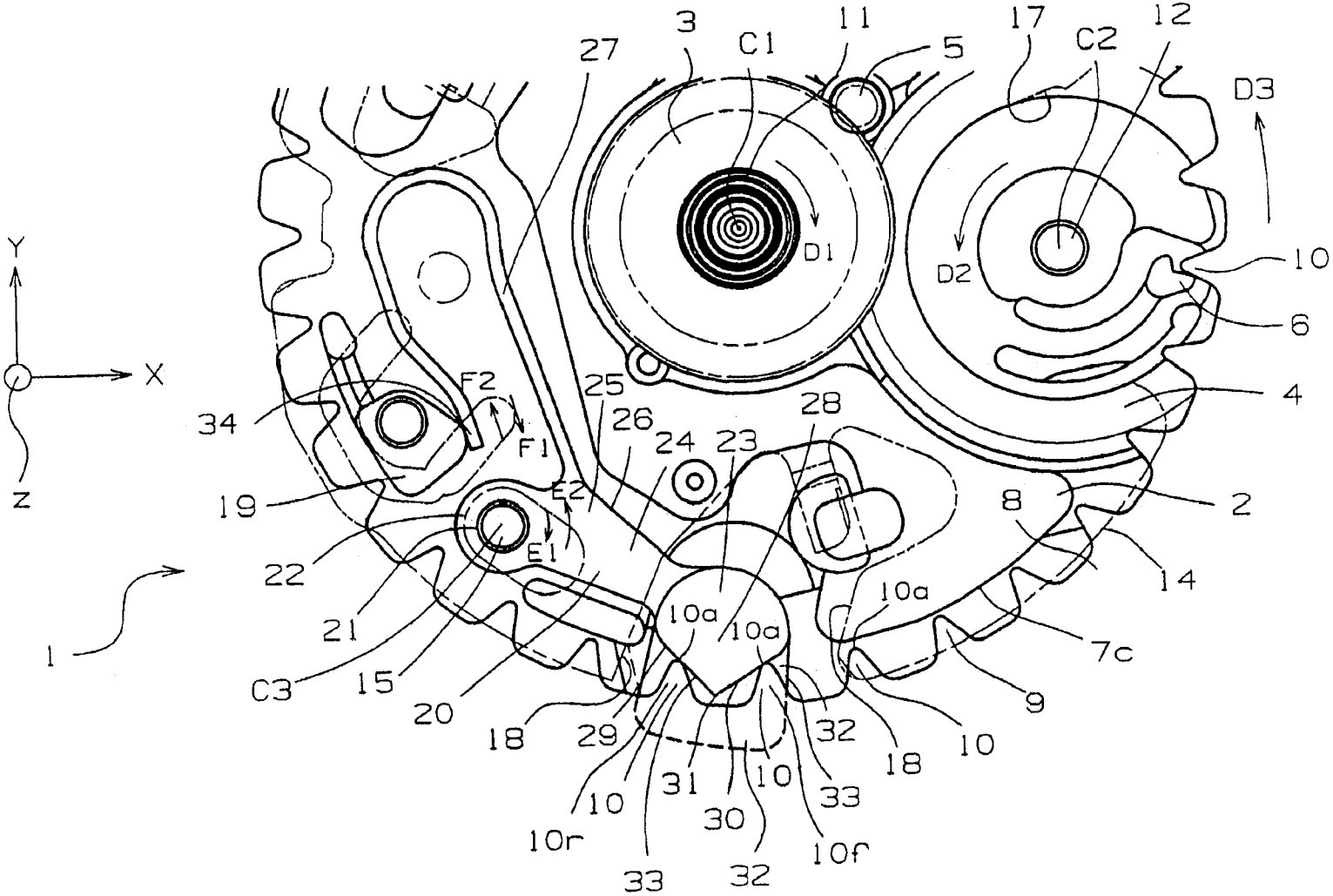
FIG. 2 is an explanatory plane view showing to enlarge a state of settling (locking) of the date jumper with regard to the watch of FIG. 1.
Figure 3:
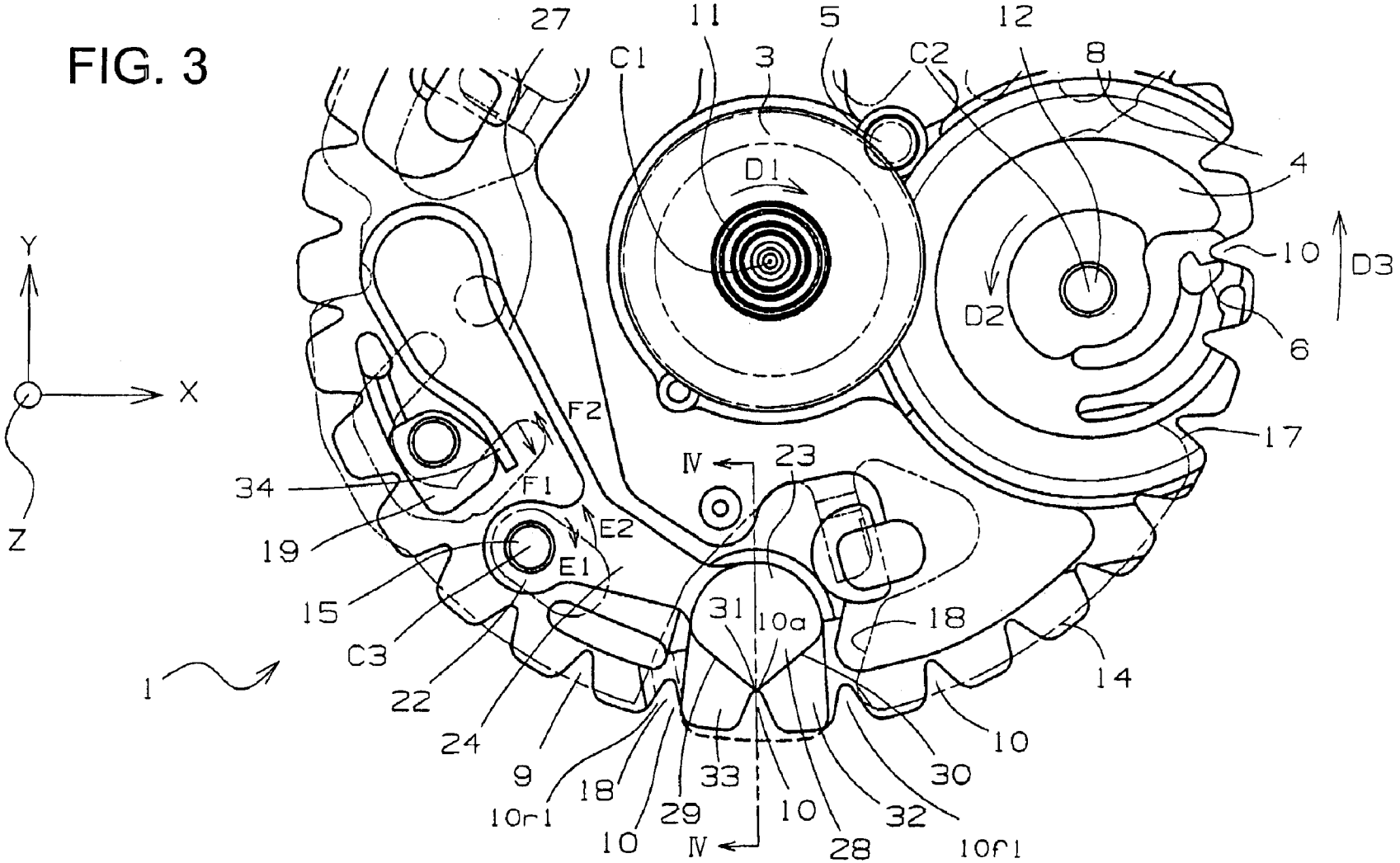
FIG. 3 is an explanatory plane view showing to enlarge a state of jumping (jumping and restricting) of the date jumper with regard to the watch of FIG. 1.
Figure 4:
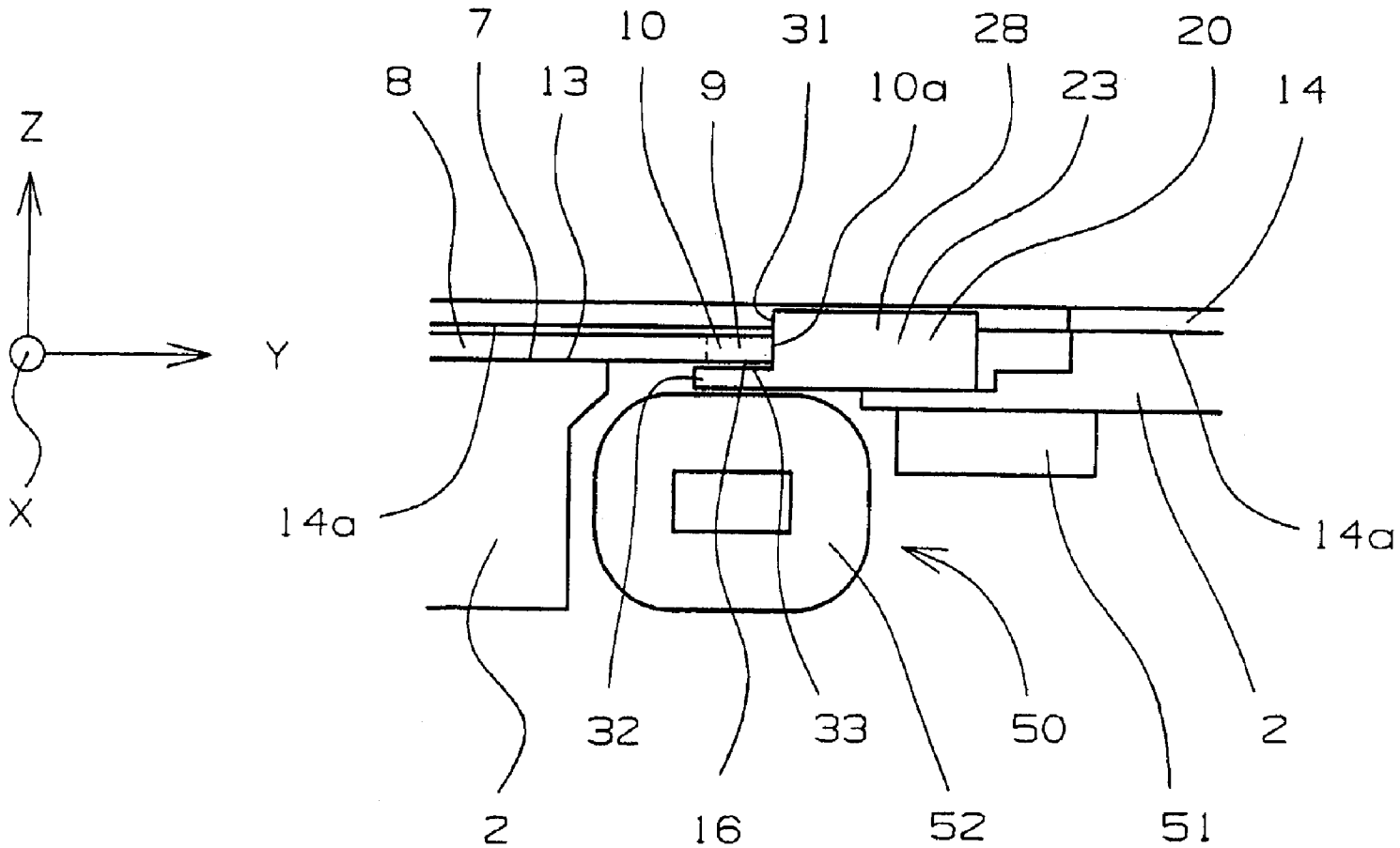
FIG. 4 is an explanatory sectional view taken along a line IV—IV of FIG. 3.

According to a watch 1 constituting a timepiece according to a preferable embodiment of the invention, as is known from FIG. 1 through FIG. 4 shown by a state of removing a case or a frame, a hand and a dial, a teeth portion of an outer periphery of a date indicator driving wheel 4 is brought in mesh with a teeth portion of an outer periphery of an hour wheel 3 attached with an hour hand and rotated relative to a main plate 2 around a central axis line C1 and during a time period in which the hour wheel 3 is rotated by two rotations in a D1 direction around the axis line C1, the date indicator driving wheel 4 is rotated by one rotation in a D2 direction around an axis line C2. Further, numeral 5 designates a minute wheel and a teeth portion of an outer periphery of the minute wheel 5 is brought in mesh with the teeth portion of the outer periphery of the hour wheel 3 and is brought in mesh with a center wheel & pinion (not illustrated) at the teeth portion of the outer periphery and transmits rotation of the center wheel & pinion to the hour wheel 3 by reducing the speed to 1/12. In FIG. 4 showing a section taken along a line IV—IV of FIG. 3, numerals 51 and 52 designate a stator and a rotor coil block of a motor 50.

Figure 1:
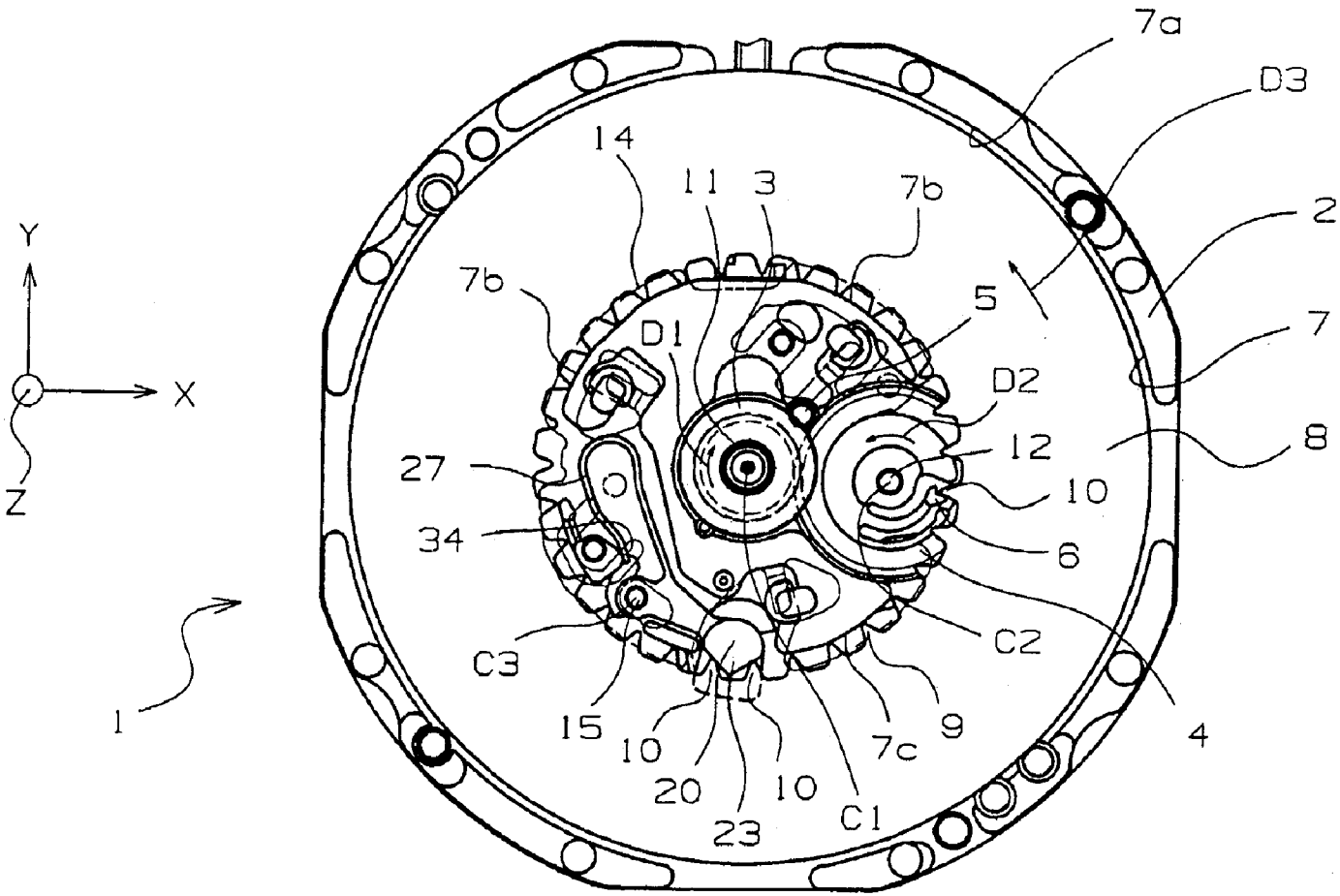
FIG. 1 is an explanatory plane view of a watch using a date jumper structure constituting a jumper structure according to a preferable embodiment of the invention (state removed of a case, a dial and the like)

For simplifying the explanation, in the following, in FIG. 1, a face in parallel with a face of the drawing is defined as X-Y plane and a direction directed to this side orthogonally to the plane is defined as Z direction.

The date indicator driving wheel 4 is provided with a date feeding finger 6 projected in Z direction at an end face on a top side thereof. The main plate 2 is provided with a recessed portion 7 substantially in a ring-like shape having a circular inner peripheral face 7*a* having a large diameter and outer peripheral faces 7*b* and 7*c* prescribing a portion of a circle having a small diameter and the recessed portion 7 is loosely fitted with a date indicator 8 in a ring-like shape in a state of leaving a clearance anticipating a maximum tolerance amount. The date feeding finger 6 can be engaged with teeth 10 of a teeth portion 9 of an inner peripheral face of the date indicator 8 having a larger diameter and substantially in a ring-like shape and during a time period in which the date indicator driving wheel 4 is rotated by one rotation, the date feeding finger 6 is engaged with one of the teeth 10 of the teeth portion 9 of the date indicator 8 and rotates the date indicator 8 by one pitch in a D3 direction.

Although a center cylinder portion 11 and a shaft portion 12 of the hour wheel 3 and the date indicator driving wheel 4 are supported by portions constituting bearings (not illustrated) at least on one end sides thereof, the date indicator 8 in the ring-like shape having the large diameter is only loosely fitted by the recessed portion 7 of the main plate 2 and is not provided with a shaft portion to be supported thereby. Therefore, displacement of the date indicator 8 in −Z direction relative the main plate 2 is restricted by a bottom face 13 (FIG. 4) of the recessed portion 7 of the main plate 2 and displacement thereof in +Z direction relative to the main plate 2 is restricted by a date indicator holder 14 shown by imaginary lines in FIG. 1 through FIG. 3 and partially shown by bold lines in FIG. 4. Further, although the date indicator 8 is typically provided with a thickness of, for example, about 0.2 mm, the thickness may be thicker or thinner than 0.2 mm. The date indicator holder 14 is provided with notched portions 17 and 18 or the like and at inside of the notched portion 17, the date feeding finger 6 of the date indicator driving wheel 5 is projected in +Z direction and is movable in the notched portion 17 and at the notched portion 18, a jumping and restricting portion 23 of a date jumper 20 constituting a jumper structure is projected in +Z direction and is movable in the notched portion 18 in a face in parallel with X-Y plane in E1 and E2 directions as described later.

The date jumper 20 is provided with a bearing hole 21 fitted to a shaft portion 15 formed at the main plate 2, and is provided with a base portion 22 rotatable around a rotational axis line or rotational center C3 in E1 and E2 direction, the jumping and restricting portion 23 for restricting rotation of the date indicator 8 in D2 direction, a rigid shaft portion 24 connecting the base portion 22 and the jumping and restricting portion 23 and a spring portion 27 substantially in a U-like shape extended from a side face 26 of a base end portion 25 of the rigid shaft portion 24 to deviate the jumping and restricting portion 23 of the date jumper 20 in E1 direction around the axis line C3. The spring portion 27 may be constituted by other arbitrary shape such as a simple linear shape or a bow shape or an arc shape or the like in place of the U-like shape so far as the spring portion 27 can exert deviating force in E1 direction to the jumping and restricting portion 23.

The jumping and restricting portion 23 is provided with jumping and restricting faces or engaging side faces 29 and 30 having a converging shape prescribing a jumping and restricting finger portion 28 for locking rotation of the date indicator 8 by fitting into an interval between a pair of the contiguous teeth 10, 10 constituting the teeth portion 9 at the inner periphery of the date indicator 8 and engaging with the contiguous teeth 10, 10. Further, the engaging side faces 29 and 30 are intersected at a front end portion 31 and the end portion 31 rides over a front end 10*a* of one of the teeth 10 in jumping or in jumping and restricting. Further, although the front end 31 is typically constituted by a dot-like shape in plane view, depending on cases, the front end 31 may be constituted by a projected shape projected to bend.

That is, during most of a time period in one rotation of the date indicator driving wheel 4, the date feeding finger 6 of the date indicator driving wheel 4 is disposed at a location remote from the teeth 10 of the teeth portion 9 of the date indicator 8 and as shown by FIG. 2, the date jumper 20 is deviated around the center axis line C3 in the E1 direction by spring force of the spring portion 27 and the jumping and restricting finger portion 28 of the jumping and restricting portion 23 is engaged with the pair of teeth 10, 10 of the date wheel 8 to thereby lock rotation of the date indicator 8. Meanwhile, every time that the date indicator driving wheel 4 is substantially rotated by one rotation, at a constant timing (end of one day) in the one rotation of the date indicator driving wheel 4, the date feeding finger 6 is engaged with the mostly proximate one of the teeth 10 on the downstream side and pushes the teeth 10 in the D3 direction against the spring force of the spring portion 27 of the date jumper 20. When the date indicator 8 is rotated in the D3 direction by rotational torque in the D3 direction around the rotational axis line C1 applied to the teeth 10, the jumping and restricting portion 23 is pivoted in the E2 direction around the center axis line C3 by a tooth 10*r* on the downstream side in the pair of teeth 10, 10 (that is, teeth 10*r* and 10*f* on the downstream side and the upstream side of FIG. 2) As a result, the date jumper 20 reaches a jumping position or a jumping and restricting position of FIG. 3 in accordance with rotation of the date indicator driving wheel 4 in the D2 direction and rotation of the date indicator 8 in the D3 direction. When the date jumper 20 slightly rides over the jumping and restricting position (jumping position), the date jumper 20 rotates the date indicator 8 by an mount of one pitch of the teeth 10 of the teeth portion 9 while being fitted to an interval between the next pair of the teeth 10, 10 in one motion by the spring force of the spring portion 27 in the E1 direction to thereby advance date indication by one day. In rotating the date indicator 8, the teeth 10 of the teeth portion 9 of the date indicator 8 leave from the date feeding finger 6 of the date indicator driving wheel 4 and next ones of the teeth 10 on the downstream side reach a position at which the ones of the teeth 10 can engage with the date feeding finger 6 only after the date indicator 4 and the date feeding finger 6 make substantially another rotation.

Figure 5:
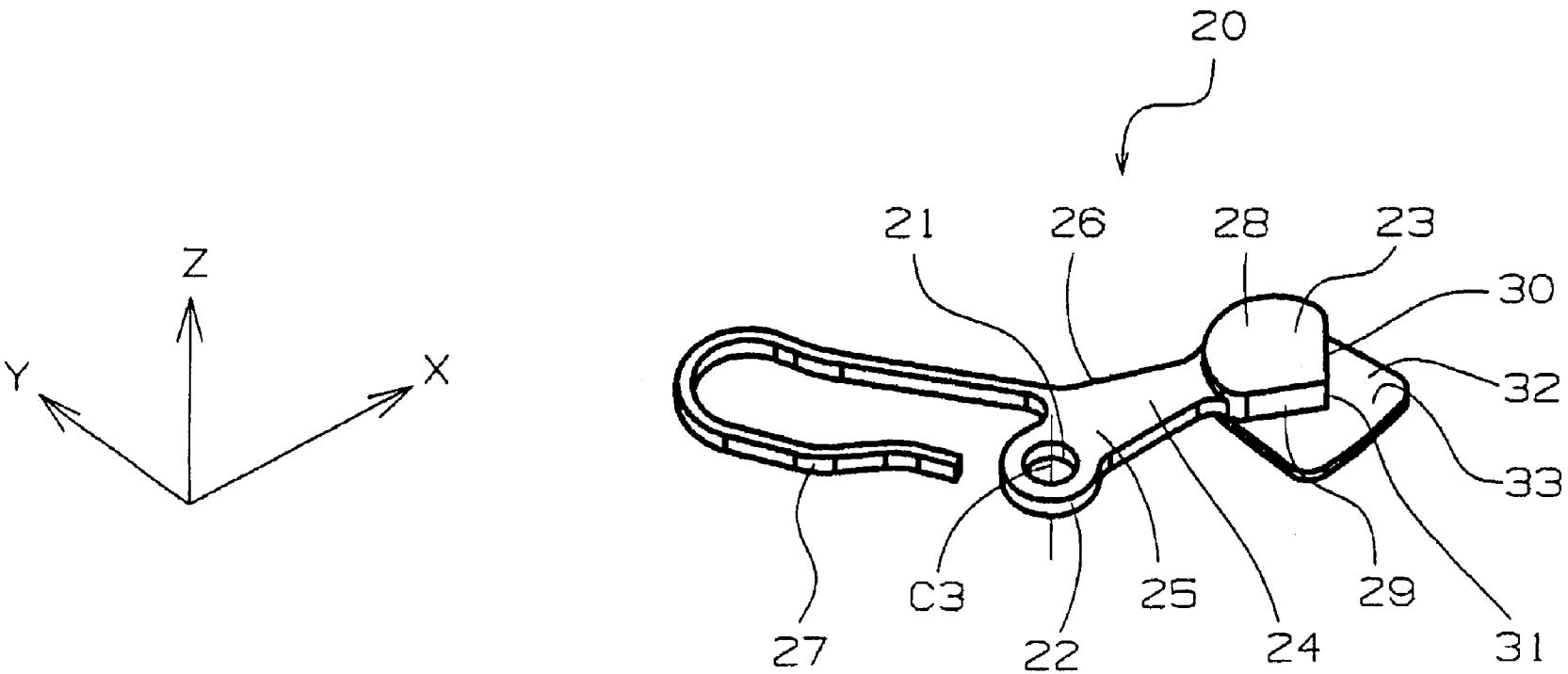
FIG. 5 is an explanatory perspective view of the date jumper of FIG. 1.

In further details, in addition to FIG. 2 through FIG. 4, as is understood from FIG. 5, a thickness of the jumping and restricting finger portion 28 of the jumping and restricting portion 23, that is, a length thereof in Z direction is larger than thicknesses or lengths in Z direction of the base portion 22, the rigid shaft portion 24 and the spring portion 27. Typically, the thicknesses of the shaft portion 24 and the spring portion 27 are about 0.2 mm and the thickness of the jumping and restricting portion 23 is about 0.5 mm. However, any of these portions may be thicker or thinner. Further, the jumping and restricting portion 23 is provided with an eaves-like flat plate portion 32 as a restricting portion projected frontward from the jumping faces or the engaging side faces 29 and 30 and the end portion 31 to have a main face substantially flush with a main face of the jumping and restricting finger portion 28 on a side proximate to the main plate 2. In this case, the front direction signifies a direction in which corresponding teeth of the date indicator 8 are disposed, that is, in this example, an outer direction in a radius direction with respect to the center C1. Further, the eaves-like flat plate portion 32 may be provided on an upper side (front face side) instead of being provided on a lower side (back face side) or may be provided on two upper and lower sides.

Further, although a position of the rigid shaft portion 24 connected to the jumping and restricting portion 23 with regard to the thickness direction Z, is typically disposed at a center portion in Z direction of the jumping and restricting portion 23 as in the illustrated example, instead thereof, the position may be a position shifted in + or −Z direction or either of main faces of the jumping and restricting portion 23 on + or −Z side may be flush with the main face on + or −Z side of the rigid shaft portion 24.

Therefore, even when respectives of the side faces 29 and 30 of the jumping and restricting finger portion 28 of the jumping and restricting portion 23 are engaged with corresponding ones of the teeth 10, 10 as shown by FIG. 2, further, even when engagement between the side faces 29 and 30 of the jumping and restricting finger portion 28 of the jumping and restricting portion 23 and the teeth 10, 10 of the teeth portion 9 is disengaged and the jumping and restricting end portion 31 of the jumping and restricting finger portion 28 rides over one of the teeth 10 along the front end 10*a* of the one of the teeth 10 of the teeth portion 9 as shown by FIG. 3, since an inner side main face 33 of the eaves-like flat plate portion 32 is disposed proximately to an outer side main face 16 of the teeth portion 9 of the date indicator 8, displacement or positional shift in −Z direction of the date indicator 8 relative to the jumping and restricting portion 23 is hampered by the eaves-like flat plate portion 32 of the jumping and restricting portion 23. Further, although the eaves-like flat plate portion 32 is extended to the back side of the outer side face 16 of the center of one of the teeth 10 in jumping, the eaves-like flat plate portion 32 may be extended to a position opposed to an outer side face (end face disposed in −Z direction) of the contiguous teeth 10,10 on both sides of the upstream side and the downstream side (that is, both or either of teeth 10*r*1 and 10*f*1, for example, one of the teeth 10 on the downstream side (that is, tooth 10*r*1).

Further, displacement or positional shift in the +Z direction of the date indicator 8 relative to the jumping and restricting portion 23, is restricted by a holding face 14*a* of the date indicator holder 14 as is known from FIG. 4. Further, since the jumping and restricting portion 23 of the date jumper 20 is thicker than the rigid shaft portion 24, the jumping and restricting finger portion 28 of the jumping and restricting portion 23 is brought into the notched portion 18 of the date indicator holder 14 in the Z direction as described above. Therefore, even when the date indicator 8 is shifted in the +Z direction relative to the jumping and restricting portion 23 to a maximum limit of being brought into contact with the inner face 14*a* of the date indicator holder 14, there is not a concern that engagement between the teeth portion 9 of the date indicator 8 and the jumping and restricting finger portion 28 of the jumping and restricting portion 23 is disengaged. Even in locking operation in which the jumping and restricting finger portion 28 of the jumping and restricting finger portion 28 of the jumping and restricting portion 23 of the date jumper 20 is engaged with at least one of the pair of contiguous ones of teeth 10, 10 of the date indicator 8 (tooth disposed on the back side with regard to the rotational direction D3), or even in jumping operation or jumping and restricting operation in which the jumping and restricting finger portion 28 is brought into contact with the apex or the front end portion 10*a* of one of the teeth 10 of the date indicator 8, the condition remains unchanged and therefore, there is not a concern of releasing engagement between the teeth portion 9 of the date indicator 8 and the jumping and restricting finger portion 29 of the jumping and restricting portion 23 in all the positions of operating the date jumper 20.

According to the date jumper 20, the jumping and restricting portion 23, that is, the jumping and restricting finger portion 28 and the eaves-like flat plate portion 32 are made of carbon nanofiber and mass thereof is small (in comparison with a case in which the jumping and restricting portion 23 is made of a metal material) and therefore, external force (inertia force) exerted to the watch by dropping the watch 1 can be restrained to a minimum. As a result, there is hardly a concern of causing a positional shift in the jumping and restricting portion 23.

In addition, the jumping and restricting portion 23, that is, the jumping and restricting finger portion 28 and the eaves-like flat plate portion 32 are made of carbon nanofiber and a frictional coefficient thereof is small and therefore, during a time period of all of the jumping and restricting operation of the date jumper 20, frictional resistance of the jumping and restricting portion 23 of the date jumper 20 against rotation of the date indicator 8 in D2 direction can be restrained to be low and therefore, it is not necessary to apply excessive load for rotating the date indicator 8.

Further, the spring portion 27 of the date jumper 20 is made of carbon nanofiber and therefore, even when the spring portion 27 is always applied with rotational torque or force in E2 direction, the spring portion 27 can exert elastic force in E1 direction without actually losing the spring performance or lowering the spring performance and continue exerting locking force to the jumping and restricting portion 23 in E1 direction around the rotational axis line C3.

Further, since the spring portion 27 of the date jumper 20 is made of carbon nanofiber, when the jumping and restricting portion 23 is pivoted in E1 and E2 directions, a supported portion 34 at a front end of "U" of the spring portion 27 in the U-like shape, can slidingly be moved pertinently in F1 and F2 directions relative to a spring receive portion 2 in a projected shape of the main plate 19 and therefore, a load state applied to the spring portion 27 can be varied regularly and periodically. As a result, according to the date jumper 20, there is rarely a concern of dispersing a jumping and restricting state by the jumping and restricting portion 23 and energy consumption of a drive source can be restrained to a minimum. Further, the base portion 22 of the date jumper 22 is made of carbon nanofiber and a frictional coefficient thereof is small and therefore, frictional resistance between the base portion 22 and the shaft portion 15 is also small, the date jumper 20 can slidingly be rotated around the rotational axis line C3, there is rarely a concern of dispersing the jumping and restricting state by the jumping and restricting portion 23 and energy consumption of a drive source can be restrained to a minimum. Further, the date jumper 20 comprises an integrally molded product and therefore, the cost in assembling or the like can be restrained to a minimum.

Although according to the above-described, an explanation has been given of an example in which the date jumper 20 constituting the jumper structure is integrally provided with the base portion 22, the-rigid shaft portion 24, the jumping and restricting portion 23 and the spring portion 27 and rotatably fitted to the shaft portion 15 at the base portion 22, so far as the jumping and restricting operation (locking and jumping and restricting (jumping) operation) can be made to be carried out at the jumping and restricting portion 23 by the spring portion 27, the base portion and the shaft portion may be dispensed with, further, the date jumper 20 may be integrally formed with other member such as the main plate. That is, the date jumper 20 may be constructed by other constitution, for example, as follows.

(1) As described in FIG. 3 of Japanese Utility Model Publication No. 2183/1988 or in FIG. 3 of Japanese Utility Model Publication No. 164183/1981, a date jumper comprising a jumping and restricting portion and a spring portion may integrally be formed with a date indicator holder. In this case, according to the present invention, also the date indicator holder is mainly made of carbon nanofiber similar to the date jumper. Further, in this case, it is preferable to make a thickness of the jumping and restricting portion thicker than a thickness of the spring portion.

(2) As described in FIG. 3 of Japanese Utility Model Publication No. 164183/1981, a day jumper comprising a jumping and restricting portion and a spring portion may further be formed integrally with the date indicator holder. Further, also in this case, it is preferable to make the thickness of the jumping and restricting portion thicker than the thickness of the spring portion.

As described above, the date jumper 20 may be provided with any other shape and structure so far as the spring portion and the restricting portion are provided to provide a jumping and restricting function to the date indicator 8. Further, the jumper structure may be other jumper such as a day jumper in place of the date jumper or may be used in a machine or an apparatus other than a watch.

What is claimed is:

1. A jumper structure for regulating angular movement of a wheel, the jumper structure comprising:

a jumping and restricting portion formed of a material containing carbon nanofibers for releasably engaging the wheel during use of the jumper structure; and a spring portion formed of a material containing carbon nanofibers and integrally formed with the jumping and restricting portion for urging the jumping and restricting portion towards the wheel.

2. A jumper structure according to claim 1; wherein the jumping and restricting portion is thicker than the spring portion.

3. A jumper structure according to claim 1; wherein the jumping and restricting portion has a finger portion for engaging teeth of the wheel and a restricting portion for restricting positional shift in a thickness direction of the jumping and restricting portion relative to the teeth of the wheel.

4. A jumper structure according to claim 3; wherein the restricting portion comprises a flat projection extending outwardly from one surface of the jumping and restricting portion and contactable with an end face of the teeth of the wheel.

5. A jumper structure according to claim 1; further comprising a pivotally supported base portion disposed between the jumping and restricting portion and the spring portion for providing a rotational center of the jumping and restricting portion.

6. A timepiece having the jumper structure according to claim 1; wherein the jumper structure is engaged with teeth of a toothed wheel to regulate rotation of the toothed wheel.

7. A timepiece according to claim 6; wherein the toothed wheel is a date wheel.

8. A jumper structure according to claim 1; wherein the carbon nanofibers are included in the material forming the jumping and restricting portion and the spring portion in a range of about 1% to 60% by weight.

9. A jumper structure according to claim 1; wherein the material forming the jumping and restricting portion and the spring portion includes a binder for mutually coupling carbon nanofibers.

10. A jumper structure according to claim 9; wherein the binder is a resin.

11. A jumper structure according to claim 10; wherein the jumping and restricting portion and the spring portion are formed by baking and carbonizing the resin.

12. A jumper structure according to claim 9; wherein the binder falls in a range of substantially voiding creep or flow of the material.

13. A jumper structure according to claim 1; wherein the carbon nanofibers are comprised of a single layer of carbon nanotubes.

14. A jumper structure according to claim 1; wherein the carbon nanofibers are formed of a plurality of layers of carbon nanotubes.

15. A timepiece comprising: a movement for counting time; a date indicator having a date wheel driven by the movement for indicating a date; and a jumper structure for regulating angular movement of the date wheel and having a jumping and restricting portion formed of a material containing carbon nanofibers for releasably engaging the wheel, and a spring portion formed of a material containing carbon nanofibers for urging the jumping and restricting portion towards the date wheel.

16. A timepiece according to claim 15; wherein the jumping and restricting portion and the spring portion comprise a one-piece structure.

17. A timepiece according to claim 15; wherein the jumping and restricting portion is thicker than the spring portion.

18. A timepiece according to claim 15; wherein the jumping and restricting portion has a finger portion engageable with teeth of the date wheel and a restricting portion for restricting a positional shift in a thickness direction of the jumping and restricting portion relative to the teeth of the date wheel.

19. A timepiece according to claim 18; wherein the restricting portion comprises a flat projection extending outwardly from one surface of the jumping and restricting portion and being in contact with an end face of the teeth of the date wheel.

20. A jumper structure according to claim 15; further comprising a pivotally supported base portion disposed between the jumping and restricting portion and the spring portion for providing a rotational center of the jumping and restricting portion.

* * * * *